United States Patent [19]

Saxman

[11] Patent Number: 4,760,890

[45] Date of Patent: Aug. 2, 1988

[54] CUTTER ASSEMBLY FOR ROTARY BORING OF EARTH

[75] Inventor: William C. Saxman, Dallas, Tex.

[73] Assignee: Tamrock Inc., Northbrook, Ill.

[21] Appl. No.: 50,443

[22] Filed: May 18, 1987

[51] Int. Cl.[4] ..... E21B 10/10; E21B 10/20

[52] U.S. Cl. ..... 175/363; 175/53; 175/364

[58] Field of Search ..... 175/364, 363, 361, 362, 175/344, 53, 355, 357

[56] References Cited

U.S. PATENT DOCUMENTS

| | | | |
|---|---|---|---|
| 2,325,459 | 7/1943 | Zublin | 175/361 X |
| 3,216,513 | 11/1965 | Robbins et al. | 175/364 X |
| 3,612,196 | 10/1971 | Dixon | 175/364 |
| 3,658,141 | 4/1972 | Schumacher, Jr. | 175/364 |
| 3,705,635 | 12/1972 | Conn | 175/364 |
| 3,747,999 | 7/1973 | Justman | 175/364 X |
| 3,749,188 | 7/1973 | Schumacher, Jr. | 175/364 |
| 3,750,772 | 8/1973 | Venter | 175/364 X |
| 3,787,101 | 1/1974 | Sugden | 175/364 X |
| 3,791,705 | 2/1974 | Schimel | 175/363 X |
| 3,835,944 | 9/1974 | Bingham | 175/364 |
| 3,836,271 | 9/1974 | Coski | 403/355 |
| 3,851,718 | 12/1974 | Fink | 175/363 |
| 3,863,994 | 2/1975 | Fink | 175/364 X |
| 3,921,734 | 11/1975 | Goodfellow | 175/364 |
| 4,046,206 | 9/1977 | Mitchell | 175/364 |
| 4,241,799 | 12/1980 | Going, III | 175/361 |
| 4,448,271 | 5/1984 | Persson | 175/364 |

*Primary Examiner*—Jerome Massie, IV
*Assistant Examiner*—Hoang C. Dang
*Attorney, Agent, or Firm*—Nixon and Vanderhye

[57] ABSTRACT

A cutter assembly for rotary boring of earth. The assembly comprises a rotating cutter having a shaft protruding from the ends of the cutter; and a mounting member for the rotating cutter. The mounting member comprises two legs the ends of which are provided with counter surfaces for the ends portions of the shaft. The assembly further comprises fastening elements provided with a counter surface, the fastening elements being fitted at the ends of the legs for fastening the shaft to the mounting member. In order to provide a self-adjusting and reliable assembly which prevents the turning movement of the shaft, the curvature of the middle portion of the counter surface of the fastening element is so formed that a gap narrowing in the direction of the periphery of the shaft is defined between the shaft and the middle portion of the counter surface of the fastening element. A clutching part extending in the radial direction is arranged at the end of the shaft. When the shaft turns, the clutching part is pressed against the counter surface, thus preventing the turning of the shaft in this direction.

11 Claims, 2 Drawing Sheets

FIG. 1
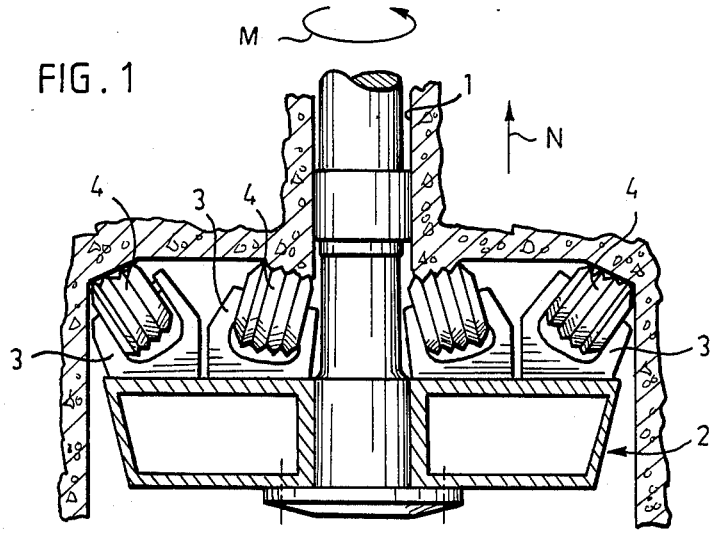
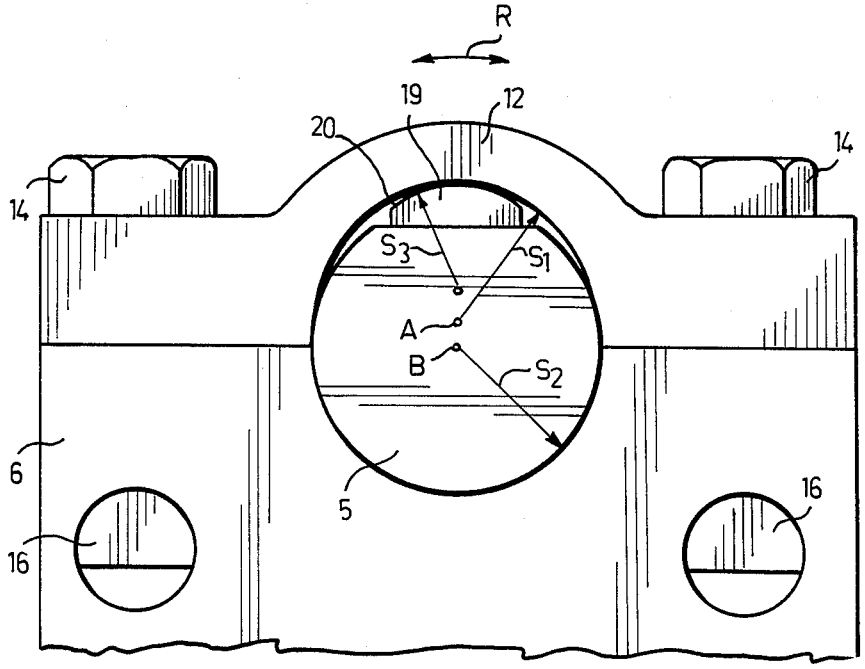
FIG. 5

CUTTER ASSEMBLY FOR ROTARY BORING OF EARTH

BACKGROUND AND SUMMARY OF THE INVENTION

The invention is concerned with rotary boring of earth. More precisely, the invention relates to a cutter assembly for rotary boring of earth, comprising a boring head, at least one rotating cutter having a shaft the end portions of which protrude from the ends of the cutter; a mounting member arranged, i.e., secured, in the boring head for the rotating cutter and provided with two mutually spaced legs the free ends of which are provided with curved counter surfaces for receiving the ends of the shaft of the rotating cutter; and fastening elements provided with a curved counter surfaces, the fastening elements being arranged at the ends of the legs of the mounting member for fastening the shaft of the rotating cutter to the mounting member. The invention further relates to an arrangement for fastening a rotating cutter to a boring head.

Assemblies of this kind are today well-known in connection with the boring of large-diameter holes, such as raises and other such tunnels. The boring of raises and the like is principally carried out, for instance, in the following way. A small diameter hole called a pilot hole is first bored from above downwards, for instance. After the boring of the pilot hole has advanced to a lower level, a large-diameter boring head is attached to the drill rod. After the boring head is positioned in place, it is rotated and simultaneously drawn upwards e.g. hydraulically in the direction of the pilot hole. Due to the rotation of the boring head while it is drawn upwards, the rotating cutters in the boring head break the earth so that a large-diameter raise is obtained.

Due to this principle of operation the structure of the cutters of the boring head is of particularly great importance. The cutters and their fastenings have to withstand very great shock stresses, compression stresses, axial stresses and torsional stresses. Furthermore, the structure has to be tight in order to protect the journalling against impurities. Besides a steady structure, the fastening of the cutters has to be such that the cutters can be detached by means of conventional tools.

Various solutions for the fastening of cutters are known in the art. Known solutions include e.g. the solutions disclosed in U.S. Pat. Nos. 3,612,196, 3,705,635, 3,863,994, 4,241,799 and 4,448,271.

Sometimes known solutions are complicated and/or the fastening is sensitive to wear, i.e. the fastening does not compensate for a clearance caused by wear, so that the service life of the device is short. This is due to the fact that the clearances caused by wear greatly accelerate the wearing process.

The object of the invention is to provide a cutter assembly and an arrangement for the fastening of the cutters, by means of which the disadvantages of the prior art can be eliminated. This is achieved by means of a cutter assembly and a fastening arrangement according to the invention, which are characterized in that the curvature of the middle portion of the curved counter surface provided on the fastening element around the end portion of the shaft of the rotating counter being so formed that a gap narrowing in the direction of the periphery of the shaft is defined between the end of the shaft and the middle portion of the counter surface of the fastening element and the assembly further comprising a rigid clutching part provided at the end of the shaft and extending outside the outer periphery of the shaft in the radial direction, the clutching part being pressed against the counter surface of the fastening element when the shaft turns, thus preventing the turning movement of the shaft in this direction.

An advantage of the invention is its simplicity, which makes the manufacture of the devices according to the invention inexpensive. The operation of the invention is also very advantageous, since the cutters will not get stuck as in some prior solutions. The cutters can be replaced with conventional tools. The solution according to the invention prevents the rotations of the shaft irrespective of the direction of rotation of the boring head. The solution according to the invention also automatically compensates any clearances caused by wear, so that the wear does not cause early failure of the attachment mechanisms.

BRIEF DESCRIPTION OF THE DRAWINGS

FIG. 1 is a general side view of a boring head which may be provided with a cutter assembly according to the invention;

FIG. 5 is a general side view of a cutter fastening arrangement according to another embodiment of the invention.

DETAILED DESCRIPTION OF THE DRAWINGS

Figure 2:
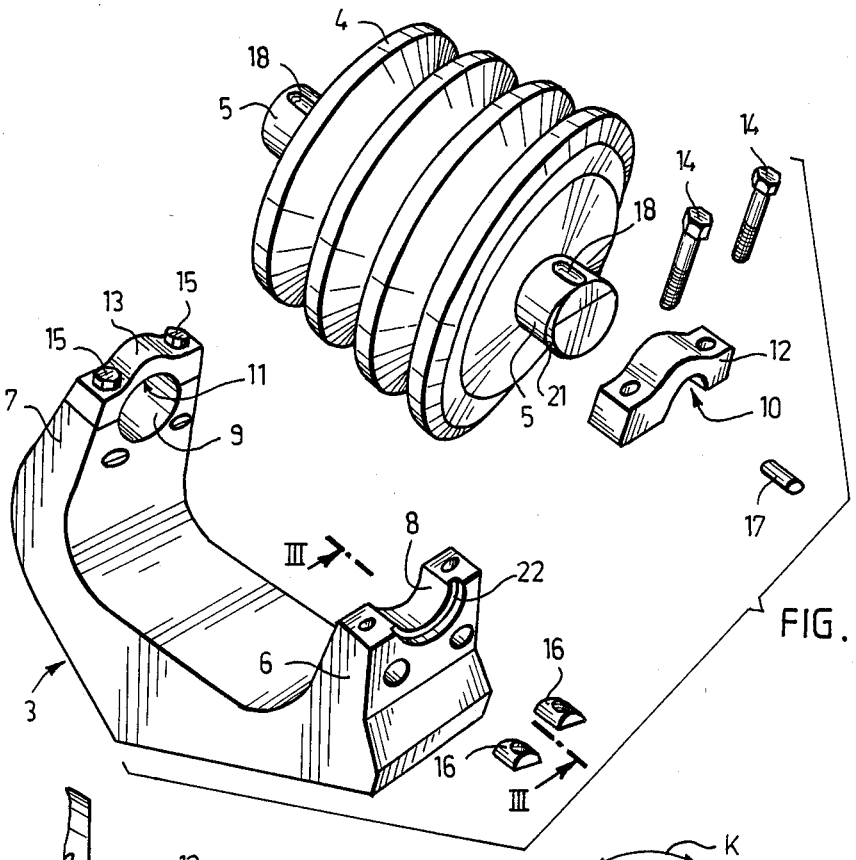
FIG. 2 is an exploded view of a cutter structure used in the embodiment of FIG. 1.

FIG. 1 shows generally a boring head which is used in rotary boring of earth. A pilot hole bored at an earlier stage is indicated by the reference numeral 1. The boring head is indicated generally with the reference numeral 2. A plurality of rotating cutters 4 is secured to the boring head 3 by means of mounting members 3. The mounting members 3 are secured to the boring means by welding, for example.

The boring head according to FIG. 2 is fastened to a drill rod (not shown in the figures) after the boring of the pilot hole is completed. After the fastening of the boring head, it is begun to be rotated at the same time as it is drawn upwards so that the cutters 4 are pressed against the earth so as to break it, as a result of which a large-diameter shaft is obtained. The boring process is described generally at the beginning of this application. The direction of the rotation and the lifting of the boring head is indicated by means of the arrows M and N respectively.

Figure 3:
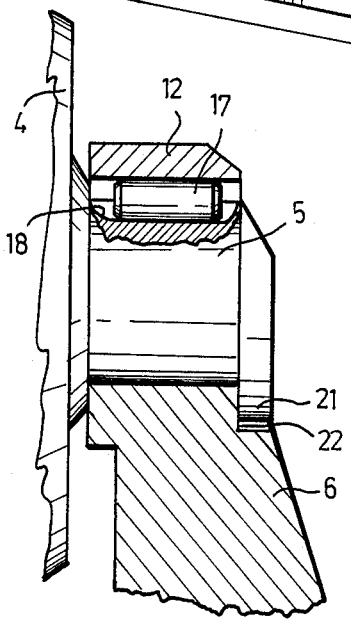
FIG. 3 is a sectional view seen in the direction of the arrows III—III shown in FIG. 2.
Figure 4:
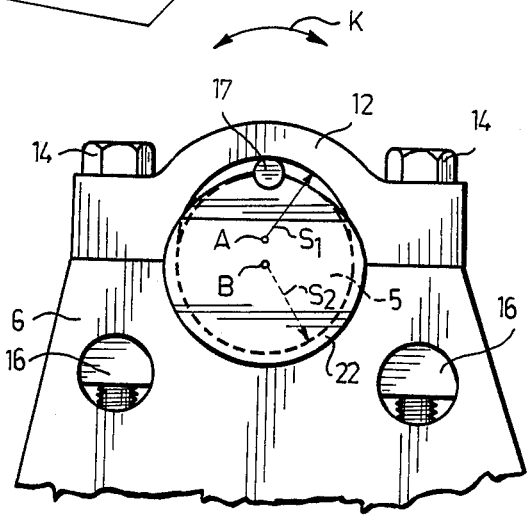
FIG. 4 is a side view of the structure seen in the direction of the shaft of the cutter.

FIGS. 2 to 4 show one cutter fastening arrangement. The reference numerals used in FIGS. 2 to 4 are the same as those used in FIG. 1. A rotating cutter 4 is fastened to the mounting member 3 which can be for instance a saddle as shown in figures. The rotating cutter comprises a shaft 5 the end portions of which protrude from the ends of the cutter 4. The mounting member 3, in turn, comprises two legs 6, 7 spaced apart, the free end portions of which legs are provided with curved counter surfaces 8, 9 for the ends of the shaft 5.

The arrangement further comprises two fastening elements 12, 13 provided with a curved counter surface 10, 11. The fastening elements 12, 13 are fastened to the legs 6, 7 by means of bolts 14, 15 and threaded parts 16, so that the cutter part supported by the legs 6, 7 will be fastened to the mounting member.

The counter surfaces provided on the fastening elements 12, 13 are so curved in the middle thereof that a gap narrowing in the direction of the periphery of the shaft 5 is defined between the end of the shaft 5 and the middle of the counter surface of the fastening element 12, 13. This structure can be realized e.g. in such a way that the radius of curvature S1 of the middle portion of the counter surface of the fastening elements 12, 13 is smaller than the radius of curvature S2 of the counter surfaces 8, 9 of the mounting member. Furthermore, the centre of curvature A of the middle portion of the counter surface of the fastening element 12, 13 is positioned higher than the centre of curvature B of the other portions of the counter surfaces.

Further, a rigid clutching part extending radially outside the outer periphery of the shaft is provided at each end of the shaft 5. When the shaft is turned the clutching part is pressed against the counter surface of the fastening element 12, 13 thus preventing the turning of the shaft in this direction. This structure can be realized e.g. by forming the clutching part of a cylindrical pin 17 which is fitted in an axial groove 18 formed in each end of the shaft 5. Another possibility is to form the clutching part of a protruding part 19 fitted in the shaft (FIG. 5), in which part 19 the radius of curvature S3 of a surface 20 facing the counter surface of the fastening element is smaller than the radius of curvature S1 of the middle portion of the counter surface of the fastening element. In other respects the embodiment of FIG. 5 corresponds to the embodiment of FIGS. 2 to 4, so the same reference numerals as in FIGS. 2 to 4 are used in FIG. 5 for corresponding parts.

In order to prevent the axial movement of the cutter 4, the ends of the shaft 5 are provided with radially protruding flanges 21 which bear on counter surfaces 22 formed on the legs 6, 7 of the mounting member.

In principle, the assembly one arrangement according to the invention operate in the following way. Initially, i.e. when no boring is being carried out, the situation is as shown in FIGS. 4 or 5. On starting to bore the large-diameter shaft, the cutters 4 make contact with the earth and start to rotate around the shafts 5. As a result of this rotatory movement and the lifting of the boring head, the shafts are exposed to forces which tend to turn the shaft according to the arrows K, R depending on the direction of rotation. This turning causes the clutching part 17 or 19 to be pressed against the counter surface of the fastening element 12, 14 so that the turning of the shaft in this direction is prevented. It is to be noted that the assembly is operative irrespective of the direction of the turning of the shaft and the direction of the rotation of the boring head, i.e. the rotation of the shaft is prevented in all cases. It is further to be noted that the assembly also compensates any clearances caused by wear, since the turning of the shaft is prevented whenever the clutching part is pressed against the counter surface of the fastening element. The extent of the turning movement before the stopping of the shaft naturally increases as a result of wear, but the stopping of the turning movement of the shaft is always effected absolutely reliably.

The above example is by no means intended to restrict the invention but it is clear that the invention or the parts thereof do not need to be exactly similar to those shown in the figures but other kind of solutions are possible as well. Accordingly, it is obvious that the cutters may be of some other type than that shown in the figures. Further, the journalling of the cutters to the shafts can be carried out in any suitable manner. The number of the cutters may be as desired. The invention is not restricted to the boring head shown in the figures, etc.

What is claimed is:

1. A cutter assembly for rotary boring of earth, comprising a boring head, at least one rotating cutter having a shaft, end portions of which protrude from the ends of the cutter; a mounting member secured in the boring head for the rotating cutter and provided with two mutually spaced legs, the free ends of which are provided with first curved counter surfaces for receiving the end portions of the shaft of the rotating cutter; and a pair of fastening elements each provided with a second curved counter surface, the fastening elements being arranged at the free ends of the legs of the mounting member such that said second curved counter surfaces cooperate with said first curved counter surfaces for fastening the shaft of the rotating cutter to the mounting member, the curvature of the middle portion of the second curved counter surface provided on each of the fastening elements being so formed that a gap narrowing in the direction of the periphery of the shaft is defined between each end portion of the shaft and the middle portion of the counter surface of the respective fastening element, and the assembly further comprising a rigid clutching part provided at each end portion of the shaft and extending outside the outer periphery of the shaft in the radial direction toward the middle portion of the second counter surface of the fastening element, each clutching part being pressed against a corresponding second counter surface of a respective fastening element when the shaft turns, thus preventing the turning movement of the shaft in this direction.

2. A cutter assembly according to claim 1, wherein the radius of curvature of the middle portion of the second curved counter surface of each fastening element is smaller than the radius of curvature of the first curved counter surface of each mounting member, and the centre of curvature of the middle portion of the second curved counter surface of each fastening element is positioned at a point differing from the centre of curvature of the other parts of the first and second counter surfaces.

3. A cutter assembly according to claim 1, wherein each rigid clutching part is a cylindrical pin fitted in an axial groove formed on each end portion of the shaft of the rotating cutter.

4. A cutter assembly according to claim 1, wherein each rigid clutching part is a protruding part mounted on the shaft, in which protruding part the radius of curvature of a surface facing the second counter surface of one of the fastening elements is smaller than the radius of curvature of the middle portion of the second counter surface of said one of the fastening elements.

5. An assembly for fastening a rotating cutter to laterally spaced legs of a mounting member to be attached to a boring head of an earth boring device, the assembly being arranged to receive sideward, torsional and compressive loads and the assembly comprising a rotating cutter provided with a shaft having end portions which protrude from opposite ends of the cutter; first curved counter surfaces formed on free end portions of each of the legs of the mounting member for receiving the end portions of the shaft of the rotating cutter; and fastening elements each provided with a second curved counter surface, the fastening elements being arranged, respectively, at the free end portions of the legs of the mounting member for fastening the shaft of the rotating cutter to the mounting member, the curvature of the middle portion of the second curved counter surface provided on each fastening element around a corresponding end portion of the shaft of the rotating cutter being so formed that a gap narrowing in the direction of the periphery of the shaft is defined between each end portion of the shaft and the middle portion of the second counter surface of the respective fastening element, and the assembly further comprising a rigid clutching part provided at each end portion of the shaft and extending outside the outer periphery of the shaft in the radial direction toward the middle portion of the second counter surface of the fastening element, each clutching part being pressed against the second counter surface of a respective fastening element when the shaft turns, thus preventing the turning movement of the shaft in this direction and, the end portions of the shaft are provided with radially protruding flanges bearing on the legs of the mounting member, said flanges preventing the movement of the cutter in the direction of the shaft.

6. An assembly according to claim 5, wherein the radius of curvature of the middle portion of the second counter surface of each fastening element is smaller that the radius of curvature of the first counter surfaces of the mounting member and the centre of curvature of the middle portion of the second counter surface of each fastening element is positioned at a point differing from the centre curvature of the other parts of the first and second counter surfaces.

7. An assembly according to claim 5, wherein each rigid clutching part comprises a cylindrical pin fitted in an axial groove formed on each end portion of the shaft of the rotating cutter.

8. An assembly according to claim 5, wherein each rigid clutching part comprises a protruding part mounted on the shaft, in which protruding part the radius of curvature of a surface facing the second counter surface of each fastening element is smaller than the radius of curvature of the middle portion of the second counter surface of each fastening element.

9. A rotary boring head comprising a rotary cutter having a mounting shaft with opposite end portions protruding from either end of the cutter;

a mounting saddle having laterally spaced leg portions, free ends of which are provided with first curved surfaces, supporting the end portions of the shaft, a pair of fastening elements for securing said shaft end portions in said mounting member, each of said fastening members comprising a second curved surface aligned with an associated one of said first curved surfaces, wherein one radius of curvature of at least a portion of said second curved surface is smaller than another radius of curvature of the associated first curved surface.

10. A rotary boring head as defined in claim 9, wherein, for each of said fastening members, said one radius of curvature extends beyond the periphery of the shaft, and a clutching member is provided between said one radius of curvature and an axial groove formed in said shaft.

11. A rotary boring head as defined in claim 10 wherein said shaft end portions are each provided with a radially protruding flange.

* * * * *